United States Patent [19]

Hoeffken et al.

[11] Patent Number: 4,663,837

[45] Date of Patent: May 12, 1987

[54] APPARATUS FOR MANUFACTURING A FURNACE HEAT EXCHANGER AND PLATE ASSEMBLY

[75] Inventors: Russell W. Hoeffken, Belleville; John M. Wiese, Red Bud, both of Ill.

[73] Assignee: SnyderGeneral Corporation, Minneapolis, Minn.

[21] Appl. No.: 770,628

[22] Filed: Aug. 28, 1985

Related U.S. Application Data

[62] Division of Ser. No. 490,729, May 2, 1983, Pat. No. 4,538,338.

[51] Int. Cl.[4] ..... B23D 15/26; B21D 41/02

[52] U.S. Cl. ..... 29/727; 29/726; 72/393

[58] Field of Search ..... 72/393, 355; 29/726, 29/727, 157.4

[56] References Cited

U.S. PATENT DOCUMENTS

| | | | |
|---|---|---|---|
| 183,241 | 10/1876 | Work | 72/393 |
| 220,651 | 10/1879 | Pagan | 72/393 |
| 2,357,123 | 8/1944 | Maxwell | 72/393 |
| 2,542,305 | 2/1951 | Brinen et al. | 72/393 |
| 3,385,087 | 5/1968 | Huth | 72/393 |
| 3,940,837 | 3/1976 | Wiese | 29/157.5 |
| 4,182,152 | 1/1980 | Vaill et al. | 72/393 |
| 4,198,844 | 4/1980 | Lowe et al. | 72/393 |
| 4,369,569 | 1/1983 | Armstrong, Jr. et al. | 29/726 |
| 4,416,142 | 11/1983 | Thorne-Thomson | 72/355 |
| 4,494,398 | 1/1985 | Svoboda | 72/393 |

*Primary Examiner*—Howard N. Goldberg
*Assistant Examiner*—Steven Nichols
*Attorney, Agent, or Firm*—Richards, Harris, Medlock & Andrews

[57] ABSTRACT

A furnace heat exchanger and support plate assembly are joined together by a cooperating oval rim defining an opening in the heat exchanger and an opening formed by a mating flange on a partition plate and extending perpendicular to the plane of the plate. The flange on the partition plate is inserted in the opening in the heat exchanger unit and expanded radially outward with respect to the central longitudinal axis of the openings by a multiple jaw expander mechanism which is inserted through the opening in the plate into the interior of the heat exchanger. A second expander apparatus is inserted in the opening after withdrawal of the first expander to engage and expand portions of the flanges which were not fully displaced by the first expander. The expander mechanisms include radially and axially movable jaws comprising plural oval shaped jaw segments which are engaged by an axially movable mandrel.

6 Claims, 23 Drawing Figures

APPARATUS FOR MANUFACTURING A FURNACE HEAT EXCHANGER AND PLATE ASSEMBLY

This is a divisional of application Ser. No. 490,729, filed May 2, 1983, now U.S. Pat. No. 4,538,338.

BACKGROUND OF THE INVENTION

1. Field of the Invention

This invention pertains to a method and apparatus for assembling a furnace heat exchanger and support plate assembly by forming rigid pressed joints between the burner and flue gas openings in the heat exchanger and cooperating openings in a support plate member.

2. Background

In the manufacture of gas fired hot air furnaces, it is known to fabricate the furnace heat exchangers by forming opposed dish shaped or clamshell sheet metal members which are joined face-to-face to form an enclosure or combustion chamber. Conventional practice in the art of heat exchanger fabrication has been characterized by welding the perimeter seam between the two clamshell sections to form an integral heat exchanger part and by assembling one or more of the heat exchanger parts to additional structure such as a partition plate having openings corresponding to the burner and flue gas openings in the heat exchanger. Welding processes are disadvantageous in that they are expensive, time consuming and create several environmental problems which are hazardous to production personnel and contribute to the overall expense of manufacturing heat exchangers.

One improvement in the art of manufacturing the subject type of heat exchanger is described in U.S. Pat. No. 3,940,837 to John M. Wiese and assigned to the assignee of the present invention. In the Wiese patent, the heat exchanger is formed with a peripheral flange on the opposed clamshell sections which is inserted through an opening in the partition or support plate and is expanded or folded over against the surface of the plate adjacent the opening to secure the heat exchanger to the plate. A layer of insulation material is also preferably inserted between the plate and the heat exchanger flange. Access to the flange for performing the folding operation is convenient, however, one drawback to the arrangement in the Wiese patent pertains to the tendency for the seams formed in the flange at the juncture between the opposed clamshell sections to split or open up during the flange deforming or folding process. This, of course, is detrimental to the structural integrity of the joint formed between the parts and provides a point of leakage of combustion gases from the heat exchanger.

One improved heat exchanger plate joint is disclosed in U.S. patent application Ser. No. 329,778, filed: Dec. 11, 1981 and assigned to the assignee of this invention. The high volume production requirements for heat exchanger and plate assemblies of the type described herein and in the abovementioned application, and the configuration of the openings in the parts themselves, has also led to a need for an improved process and apparatus for assembling a clamshell type heat exchanger to a partition or support plate to form a joint at the respective openings for the burner assembly and flue gas discharge. The requirements to develop a suitable pressed joint heat exchanger and plate assembly has been accentuated by the successful development of the perimeter flange pressed joint disclosed and claimed in U.S. Pat. No. 4,298,061, also assigned to the assignee of this invention.

Moreover, it has been determined that a method and apparatus for providing a suitable no weld connection between a heat exchanger assembly and a supporting plate structure should, in addition to assuring a leakproof joint, be adapted for forming said joint with various thicknesses of metal, or at least being capable of forming the joint while taking into account the tolerances in metal thickness and dimensional variations in mating parts associated with relatively high volume production of heat exchangers for heating equipment for home and industrial furnaces. These objectives have been met with the method and apparatus for manufacturing a heat exchanger and plate assembly in accordance with the present invention.

SUMMARY OF THE INVENTION

The present invention provides an improved method and apparatus for manufacturing a heat exchanger and plate assembly for gas fired hot air furnace structures wherein a substantially rigid joint is formed between one or more openings in a clamshell type heat exchanger and a partition or supporting plate therefor.

In accordance with one aspect of the present invention there is provided a method for forming a pressed joint between a heat exchanger and a so called partition plate or pouch plate wherein a peripheral flange formed about an oval shaped opening in the plate is inserted into a corresponding oval shaped opening in the heat exchanger and deformed or folded outwardly into engagement with the inner wall surface of a shoulder formed around the opening in the heat exchanger. In a preferred method in accordance with the invention the joint is formed around the oval shaped opening by a multiple jaw press or expander apparatus which is inserted through the opening in the plate and the heat exchanger, followed by expansion of the jaws to carry out the folding or deforming process, and then retraction of the jaws to permit removal of the apparatus. The initial pressing operation is followed by insertion of a second expander apparatus to fully deform or fold portions of the flange which were not forcibly engaged by the jaws of the first apparatus.

In accordance with another aspect of the present invention a substantially rigid pressed joint is formed between a plate member and a heat exchanger member at cooperating openings in both members by deforming a peripheral flange on the plate member into forcible engagement with the inner wall surface of a shoulder formed around the opening of the heat exchanger and wherein an axial movement of flange deforming jaws is carried out to assure that a leakproof joint is formed regardless of variations in metal thickness and other dimensional variations of the cooperating plate and heat exchanger parts. In this regard, the present invention also provides an improved apparatus for forming a rigid pressed joint between a heat exchanger and plate assembly. The expander or joint forming apparatus is adapted to be inserted through an opening in the plate member into the interior of the heat exchanger unit wherein a plurality of jaws are moved radially outward and then axially to forcibly engage and fold a seamless flange radially outward and into forcible engagement with a rim formed on the heat exchanger. The jaws are then retracted axially and radially to permit removal of the apparatus from the opening.

In accordance with still a further aspect of the present invention a pressed joint is formed at an opening in cooperating heat exchanger and supporting plate parts wherein a fold or deforming operation is carried out by jaws having die surfaces which curl the end of the flange of the partition plate to form a superior rigid pressed joint which will remain tight under substantial thermal stress imposed thereon in the operating environment of a gas fired hot air furnace.

Those skilled in the art of furnace heat exchanger assemblies including manufacturing methods and apparatus therefor will appreciate the above-noted features of the present invention as well as the improved manufacturing method together with additional superior aspects of the invention upon reading the detailed description which follows in conjunction with the drawings.

DESCRIPTION OF THE PREFERRED EMBODIMENTS

Figure 1:
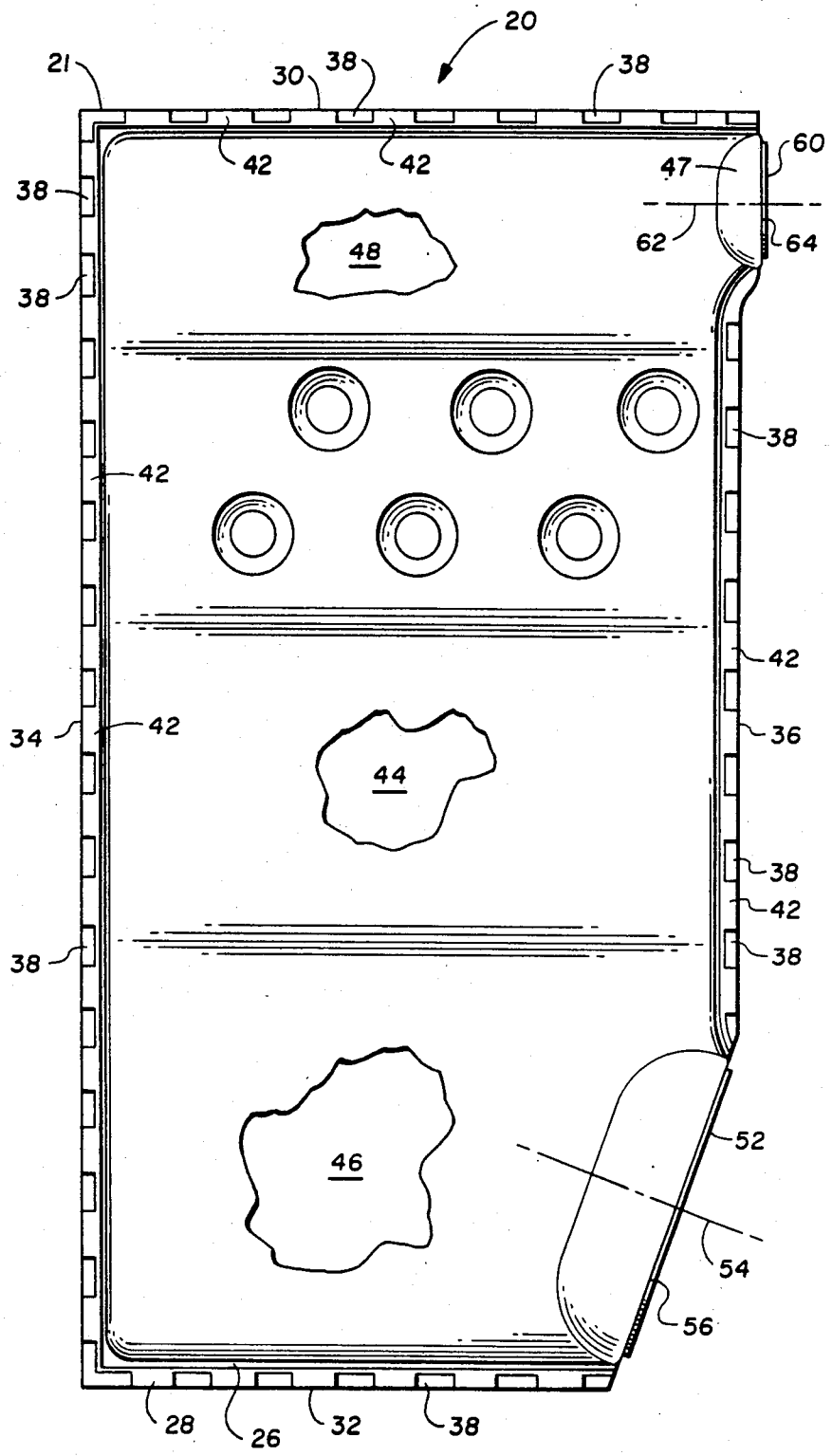
FIG. 1 is a side elevation of a heat exchanger unit for a gas fired furnace.

In the description which follows, like parts are marked throughout the specification and drawings with the same reference numerals, respectively. The drawings are not necessarily to scale and certain features of the invention may be shown exaggerated in scale or in somewhat schematic form in the interest of clarity and conciseness.

Figure 2:
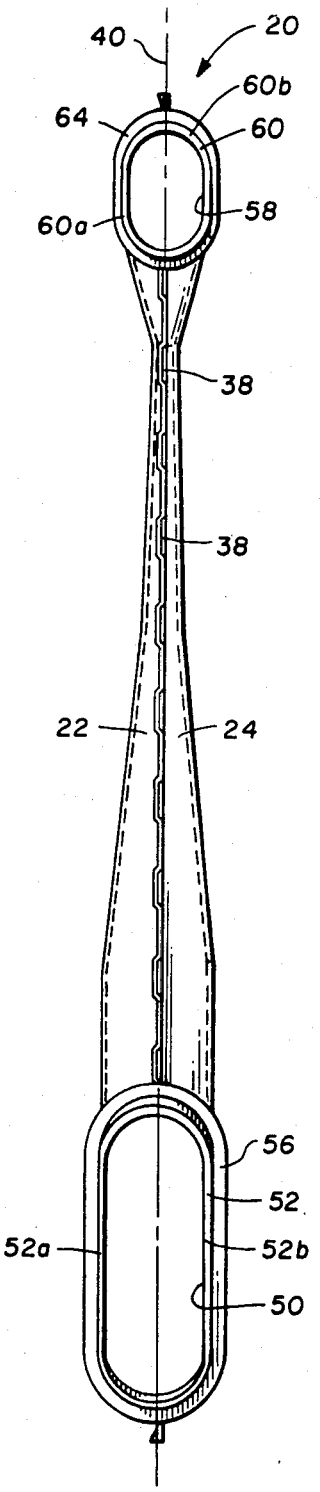
FIG. 2 is an end elevation view of the heat exchanger unit.

Referring to FIGS. 1 and 2, there is illustrated a heat exchanger unit for a gas fired hot air furnace, generally designated by the numeral 20. The heat exchanger 20 is characterized by opposed deep drawn metal shell sections 22 and 24 which are formed of relatively light gauge steel, for example. The sections 22 and 24 are each formed with a perimeter flange 26 and 28, respectively, and are joined together face-to-face along said flanges in accordance with the arrangement disclosed and claimed in U.S. Pat. No. 4,298,061, to form a superior gastight joint between the sections.

Briefly, the improved joint is formed by folding the flange 28 over the flange 26 along a top edge 30, bottom edge 32 and opposed side edges 34 and 36, respectively, and then forming lengthwise spaced apart edge portions 38 which are displaced from a longitudinal central plane 40, FIG. 2, at an acute angle with respect to edge portions 42 extending between the edge portions 38 to prevent loosening of the joints between the clamshell sections 22 and 24 when the heat exchanger undergoes the extreme heating and cooling cycles to which such apparatus is normally subjected. The joining of the sections 22 and 24 forms an interior chamber 44 having an enlarged portion 46 at the bottom portion of the heat exchanger and an enlarged portion 48 at the top. An oval shaped opening 50 is formed in one end wall of the heat exchanger unit into the chamber portion 46 to provide for insertion of a burner assembly, not shown, of a conventional type known in the art of gas fired hot air furnaces. The oval opening 50 is formed with a rim 52 having complementary portions **52*a* and 52*b* formed on the respective sections 22 and 24, which form a continuous perimeter rim when the shell sections are joined together. The rim 52 is formed with a shoulder 56 joining the rim itself to the respective wall portions of the sections 22 and 24 and extending generally in a plane perpendicular to the central axis 54 of the opening 50**.

The upper end of the heat exchanger 20 is provided with a second somewhat oval shaped opening 58 to provide an outlet for the chamber portion 48 for discharging combustion products from the heat exchanger. The opening 58 is delimited by a perimeter rim 60 having opposed portions **60*a* and 60*b* formed on the respective heat exchanger sections and extending generally parallel to a longitudinal central axis 62 of the opening 58. The rim 60 is also joined to the main portions of the sections 22 and 24 by an integral shoulder 64 which extends in a plane substantially perpendicular to the axis 62**.

Figure 3:
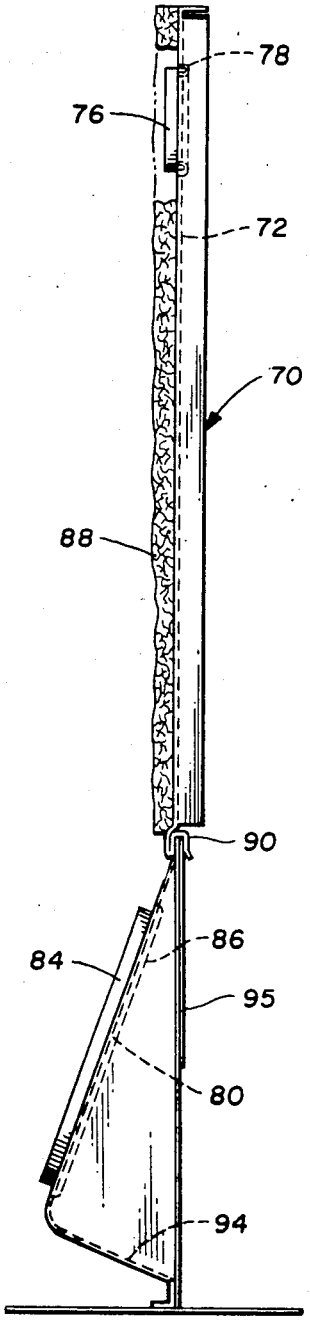
FIG. 3 is a side elevation of a plate assembly to which the heat exchanger unit is attached in accordance with the prsent invention.
Figure 4:
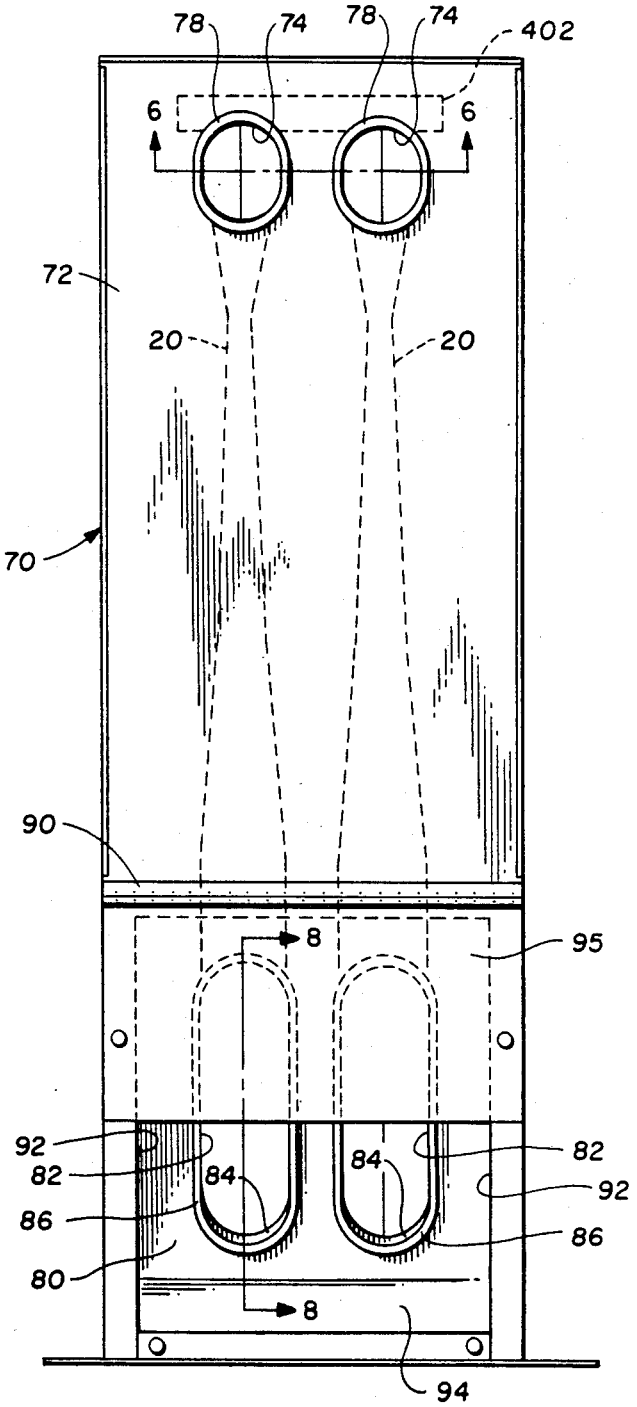
FIG. 4 is a front elevation of the plate assembly.

Referring now to FIGS. 3 and 4, there is illustrated a support plate assembly, generally designated by the numeral 70 for joining at least two heat exchanger units 20 in assembly therewith. The plate assembly 70 is adapted to be secured to additional structure making up a furnace, not shown, in which the heat exchanger units 20 are used. The plate assembly 70 includes a partition plate 72 including spaced apart oval shaped openings 74 each delimited by a seamless perimeter flange 76 which is joined to the plate 72 by an integral annular channel shaped portion 78. The formation of the flange 76 including the channel shaped portion 78 may be carried out using substantially conventional steel press or drawing equipment.

The plate assembly 70 also includes a so called pouch plate 80 which is also formed with spaced apart oval shaped openings 82 corresponding to the openings 50 in the respective heat exchanger sections and delimited by a seamless perimeter flange 84 extending substantially perpendicular to the plane of the plate section 80. The flanges 84 also include integral channel shaped portion 86 joining the respective flanges to the remainder of the pouch plate 80. The plate assembly 70 may take various forms and may, for example, include a layer of insulating material 88 attached to the side of the plate assembly to which the heat exchanger units are to be secured. The plate assembly 70 may be formed as an integral unit or may comprise a separate partition plate section 72 and pouch plate section 80 joined together along a joint 90. The pouch plate 80 may also be formed as a somewhat pan shaped member having opposed sidewalls 92 a bottom wall portion 94 and a separate cover plate 95, as shown, to provide a space for portions of the aforementioned burner assemblies, not shown. In FIG. 4 the heat exchanger units 20 are shown in their assembled position with respect to the plate assembly 70.

Figure 5:
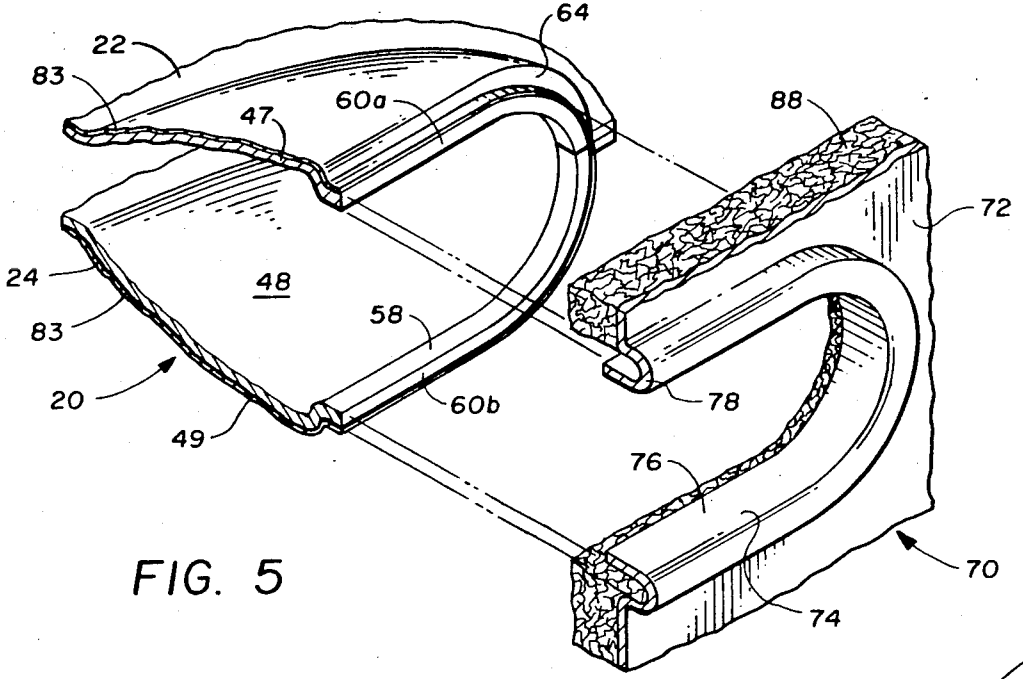
FIG. 5 is a fragmentary exploded perspective view showing the cooperating portions of a partition plate and a heat exchanger unit at the combustion gas outlet opening.
Figure 6:
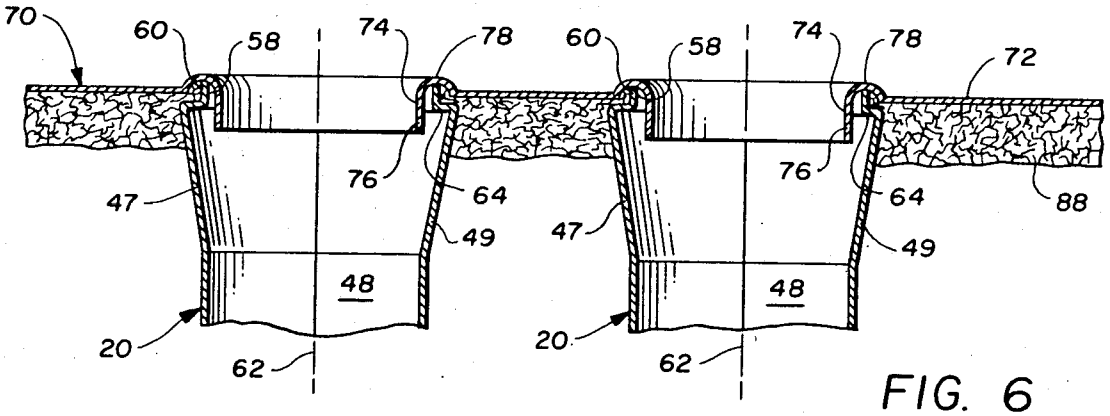
FIGS. 6 and 7 are sectional views taken on the plane of line 6—6 of FIG. 4 illustrating the steps in the formation of a leakproof rigid pressed joint at the combustion gas outlets of the heat exchanger assembly.

Referring now to FIGS. 5 and 6, by way of example, the partition plate 72 is shown positioned such that each of the continuous flanges 76 project into the associated openings 58 in the respective heat exchanger units 20 positioned side-by-side in preparation for the joining operation of the plate assembly to the heat exchanger units. As illustrated in FIG. 6, the respective rims 60 project into cooperating continuous oval shaped recesses formed by the channel shaped portions 78 of the flanges 76. In contrast with prior art arrangements of joining heat exchangers to cooperating supportive plate members, the continuous seamless flanges 76 are each folded radially outwardly with respect to the longitudinal central axes 62 into tight engagement with the inner wall surface of the shoulders 64 formed around the openings 58.

Figure 7:
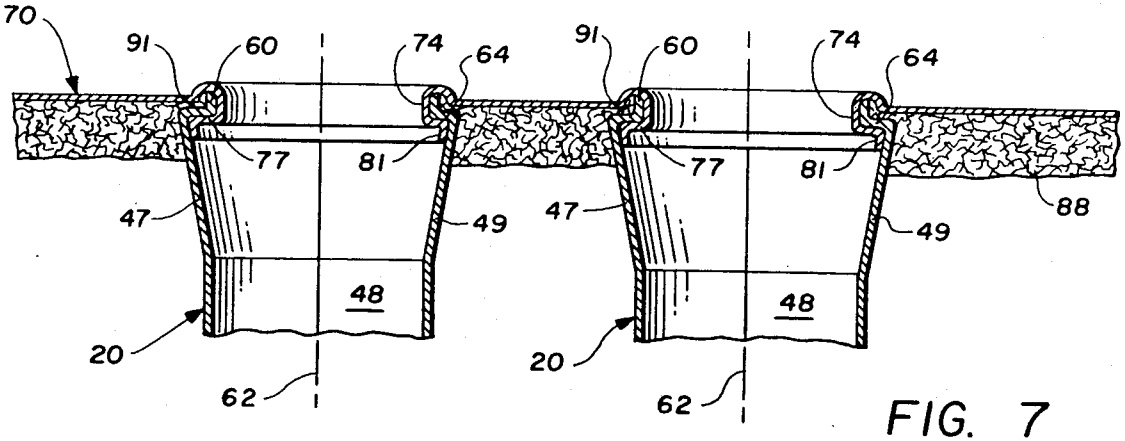

The final secured position and shape of the flanges 76 is illustrated in FIG. 7 wherein, as shown, the recesses formed by the channel shaped portions 78 are closed. Moreover, the distal ends of the flanges 76 are caused to be contiguous with the shoulders 64 and sidewall portions 47 and 49 of the respective shell sections 22 and 24. Accordingly, a shoulder 77 is formed on the flanges 76 and a distal end portion 81 is formed conforming to the oval shaped opening formed by the sidewalls 47 and 49. As indicated in FIG. 7, it may also be desirable to provide for trapping a small portion of insulation 91 between the plane of the partition plate 72 and the shoulder 64 formed by the rims 60. Alternatively, a bead of high temperature sealant may also be provided around the outside surface of the shoulders 64 to form a gasket upon closure of the joint.

The displacement of the flanges 76 as described above provides several advantages in providing a leakproof joint in a furnace heat exchanger and plate assembly. The folding or displacement of the flanges 76 are advantageous in that these flanges are seamless and there is no tendency for a seam to open during the material displacement process to therby form a point of fluid leakage through the joint. Moreover, the surfaces of the heat exchanger units are preferably provided with a porcelain enamel coating 83, FIG. 5, which reduces corrosion and enhance the heat transfer charcteristics of the units. Substantial displacement of heat exchanger material in the vicinity of the rims 60 would tend to break such coatings, particularly if they are brittle in nature, such as the aforementioned porcelain type coating typically used in conjunction with furnace heat exchanger units. Accordingly, the heat exchanger units 20 can be processed to have the coating 83 applied before the plate assembly 70 is joined to the heat exchanger units and it is not necessary to coat the entire assembly after the joining operations.

Figure 8:
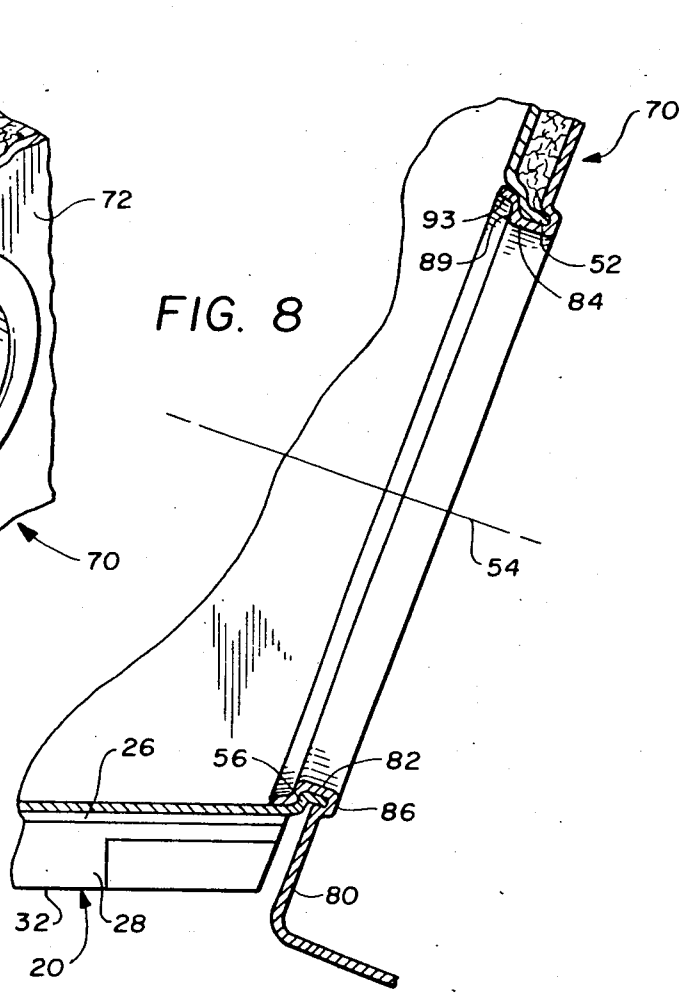
FIG. 8 is a detail section view taken along the line 8—8 of FIG. 4.

Referring briefly to FIG. 8, the joint formed between the pouch plate 80 and each of the heat exchanger units 20 is of a similar configuration. In joining the plate assembly 70 to the respective heat exchanger units, both units and the plate assembly are preferably mounted in suitable fixtures, not shown, with the flanges 76 and 84 projecting into the respective openings 58 and 50. In regard to the joint formed between the pouch plate 80 and the heat exchanger units 20 the rims 52 extend into annular recesses formed by the channel shaped portions 86 of the flanges 84. As indicated in FIG. 8, a small amount of insulating material 88 may be trapped between the shoulder 56 and the plate 80, if desired, or the rim 52 may be dimensioned such that the shoulder 56 will be flush or contiguous with the plane of the plate 80 when the flanges 84 are folded radially outwardly with respect to the axes 54. The plastic deformation of the flanges 84 into the configuration illustrated in FIG. 8, by way of example, forms a radially outwardly extending shoulder 89 and a generally axially extending distal end portion 93 of the flange. Accordingly, a joint similar to that previously described for the openings 58 is formed which is substantially gas tight and basically requires only the displacement of a seamless member to minimize the chance of joint leakage. Moreover, the rigidity of the joint formed as described is greater than joints wherein the flange or rim around the heat exchanger opening is displaced or folded over a planar surface. This rigidity is due in part to the displacement of material in two directions as indicated by the formation of the shoulder 89 and the distal end portion 93. The above-mentioned type of joint maintains its integrity to a greater degree than prior art weldless joints when subjected to the extreme cycles of temperature change associated with furnace heat exchangers.

Figures 9, 10:
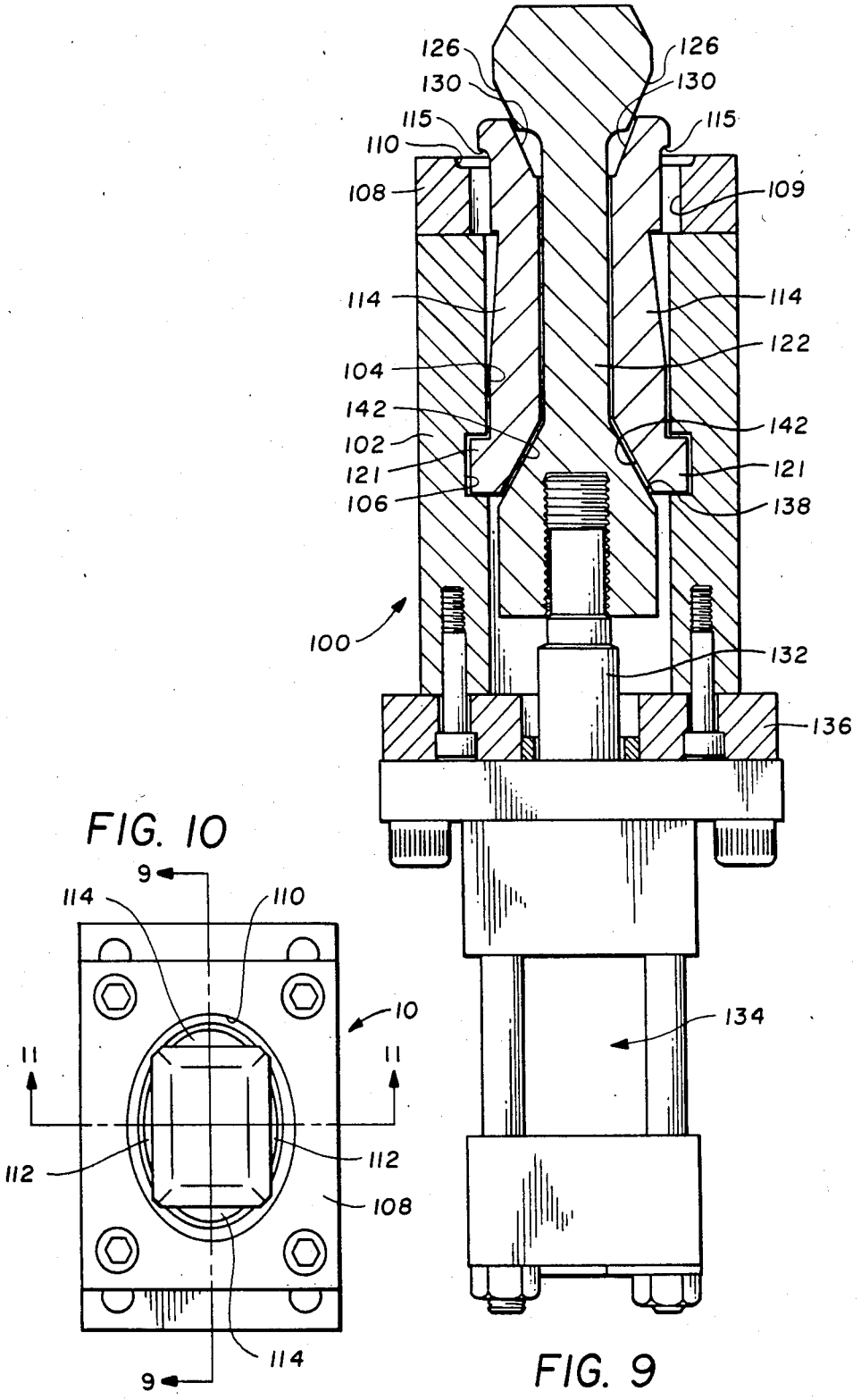
FIG. 9 is a side elevation, partially sectioned along line 9—9 of FIG. 10, of an apparatus for forming the pressed joint between a heat exchanger opening and a plate assembly.
FIG. 10 is a top end view of the apparatus of FIG. 9.
Figure 11:
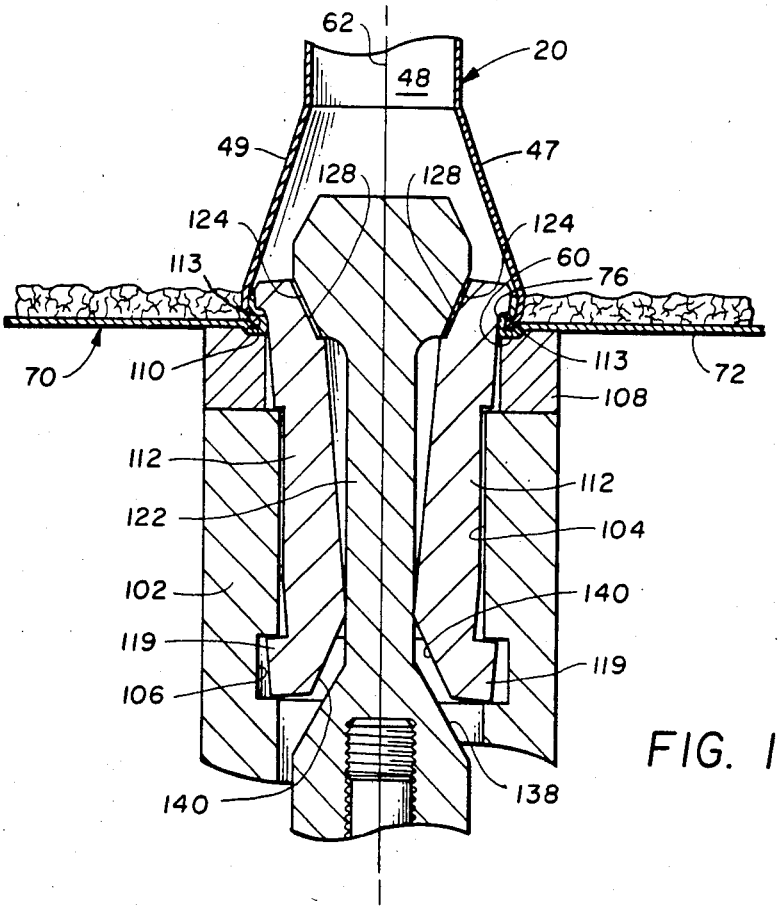
FIG. 11 is a section view taken along line 11—11 of FIG. 10 and showing the apparatus of FIGS. 9 and 10 forming a pressed joint between the heat exchanger and the partition plate.

The formation of the rigid pressed joints between the flanges 76 and 84 and the associated rims of the heat exchanger units 20 is carried out in a particularly unique manner. The displacement of the flanges 76 and 84 is particularly difficult since access to the flanges must be obtained through the respective openings delimited by the flanges. This is due to the fact that there is virtually no access to the vicinity of the flanges from within the enclosures 46 and 48 due to the nature of the closure formed by the heat exchanger shell sections. Referring now to FIGS. 9, 10 and 11, there is illustrated one embodiment of an apparatus for forming the joints described between the plate assembly 70 and the respective heat exchanger units 20. The apparatus illustrated in FIGS. 9 and 10 comprises an expander mechanism, which for the sake of description will be referred to in regard to forming the joints at the smoke or combustion products outlet openings 58. The expander for the openings 58 is generally designated by the numeral 100 and comprises a body member 102 having a bore 104 with an annular recess 106 formed therein. The body member 102 includes a separable die part 108 having an oval shaped bore 109 and a recess or groove 110 for receiving the channel shaped portions of the flanges 76 as shown in FIG. 11. The expander 100 is further characterized by four expander jaw segments 112 and 114. The respective segments 112 and 114 are arranged in opposed relationship to each other and are each provided with a curved surface 113 and 115, respectively for engagement with the sidewalls of the flanges 76 to displace the flanges radially outwardly to form the shoulders 77 in response to radial movement of the respective jaw portions outwardly with respect to longitudinal axis 62.

The respective jaws 112 and 114 each include radially projecting shoulder portions 119 and 121 which project into the recess 106 when the jaw members are assembled in the bore 104 of the body 102. The jaws 112 and 114 are adapted to be engaged by a mandrel 122 having opposed surface portions 124 and 126 engageable with cooperating cam surfaces 128 and 130 on the respective jaw members 112 and 114. The mandrel 122 is connected to the piston rod 132 of a conventional double acting pressure fluid cylinder and piston assembly 134 suitably mounted on a flange 136 of the body member 102. The cylinder assembly 134 is adapted to be connected to a source of hydraulic fluid, not shown, and to be actuated to move the mandrel axially along the axis or centerline 62, FIG. 11.

In the position illustrated in FIG. 9 the expander 100 is adapted to be inserted through the opening 58 and the apparatus is located with respect to the plate assembly 70 by moving the die member 108 into registration of its groove 110 with the channel shaped flange portions 78. With the jaw members 112 and 114 in the retracted position shown the jaws and the mandrel 122 may be inserted through the cooperating openings in the plate 72 and the heat exchanger 20 into a flared portion of the chamber 48, as illustrated in FIG. 11. Upon actuation of the cylinder 134 to draw the mandrel 122 downwardly, viewing FIGS. 9 and 11, toward the jaws 112 and 114, the cooperating cam surfaces between the mandrel and the respective jaw members become engaged and the jaws are moved radially outwardly to displace the flange 76 into the position shown in FIGS. 7 and 11. By actuating the cylinder 134 to move the mandrel in the reverse direction, a somewhat conical shaped cam surface 138 on the mandrel base engages cooperating surfaces 140 and 142 on the jaws to retract the jaws into the position shown in FIG. 9. Accordingly, the expander 100 can be inserted through the openings formed in the plate assembly 70 and withdrawn from same.

Figure 12:
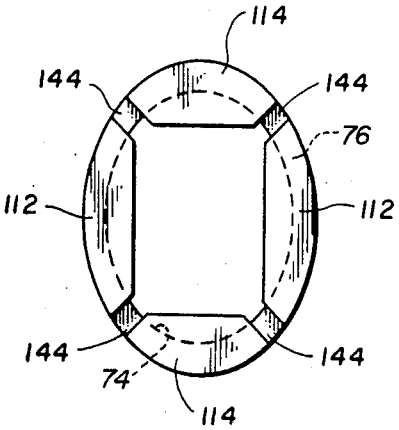
FIGS. 12 and 13 are diagrams showing the jaw patterns of the apparatus illustrated in FIG. 9 and of a similar apparatus for completing the pressing operation.
Figure 13:
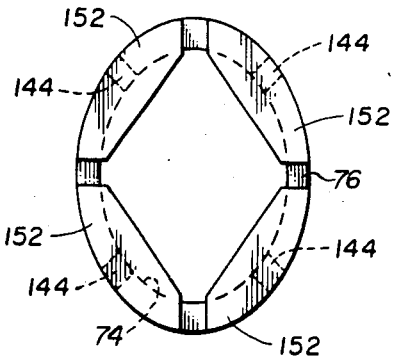

Referring now to FIG. 12 there is illustrated a diagram of the contact pattern formed by the jaw surfaces 113 and 115 as the jaws move radially outwardly to engage and displace the flange 76. The radial outward movement of the respective jaws 112 and 114 results in four circumferentially spaced apart areas 144 on the flange 76 which are not folded tight against the shoulder 64 of the rim 60. Accordingly, upon withdrawal of the expander 100 from the heat exchanger openings, a second expander, having a set of jaws of a different pattern and which overlap the areas 144, is inserted into the opening in the plate 72 and engaged with the flanges 76 to fully crimp or fold the flanges in the areas 144 to be substantially planar with the areas folded by the jaws 112 and 114. FIG. 13 illustrates the pattern of opposed jaws 152 which are operable when used in conjunction with an apparatus substantially similar to the apparatus 100 to form the final clinching or folding operation to provide a leakproof joint between the plate assembly and the heat exchanger at the combustion products outlet openings 74 and 58.

Figure 14:
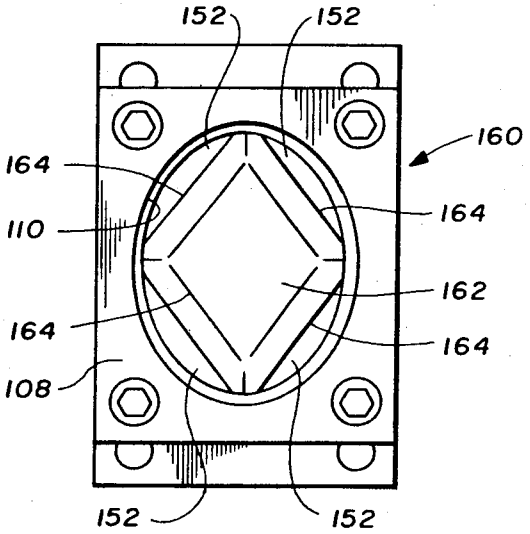
FIG. 14 is an end view of an apparatus similar to that shown in FIGS. 9 and 10 and having the jaw pattern of FIG. 13.
Figure 17:
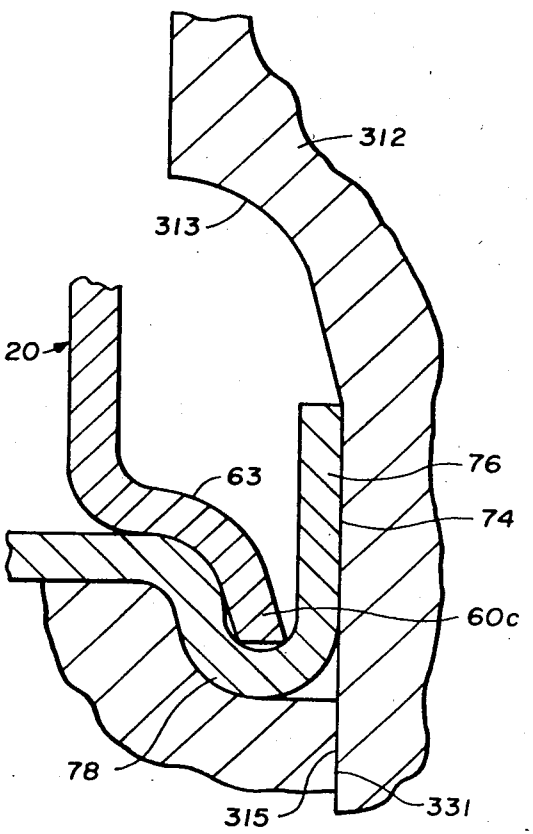
FIGS. 16 through 19 illustrate another arrangement for forming a joint between a heat exchanger and plate in accordance with the present invention.

Referring briefly to FIG. 14, there is illustrated an end view of an apparatus 160 similar in substantially all respects to the expander apparatus 100 except that a modified mandrel 162 is provided which has cooperating opposed cam surfaces 164, the edges of which are shown in the drawing figure. The cam surfaces 164 are engageable with the respective jaws 152 to expand the jaws radially outwardly into the position illustrated in FIG. 13 to perform the final clinching or displacement of the areas 144 previously described.

Those skilled in the art will appreciate that similar expander apparatus may be used to displace the flanges 84 to form the joints between the pouch plate 80 and the heat exchanger units at the respective openings 50 and 82. The joint forming operations may be carried out simultaneously on suitable apparatus supporting a plurality of expander devices corresponding in number to the number of openings in the plate assembly.

Figure 15:
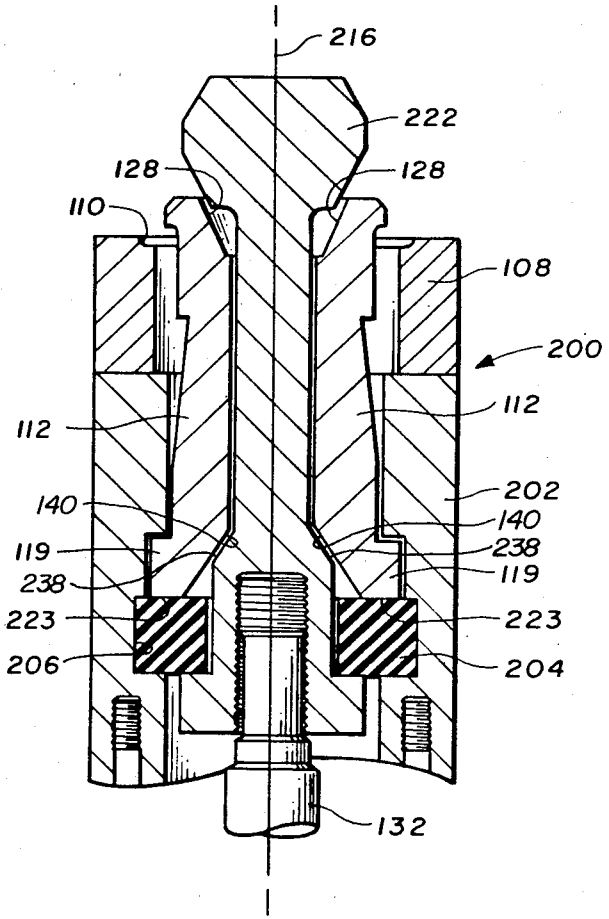
FIG. 15 is a longitudinal section view of a portion of an alternate embodiment of a pressing apparatus.

Referring now to FIG. 15, there is illustrated another modified arrangement of an expander, generally designated by the numeral 200, which is similar to the apparatus or device 100 and 160 except that a modified body 202 is provided which has an elastically deformable block 204 disposed in a circumferential groove 206. The block 204 may be formed of a suitable elastomeric material such as synthetic rubber or a urethane elastomer. In the arrangement of the expander 200 actuation of the cylinder assembly to move piston rod 132 to draw mandrel 222 downwardly, viewing FIG. 15, will first result in radial outward displacement of the opposed jaw members 112 and 114 as occurs with the expander 100.

Continued axial downward displacement of the mandrel 222 will result in forcible engagement of cooperating shoulders 223 on the respective jaws with the block 204 resulting in some axial displacement of the jaws along the axis 216 downward, viewing FIG. 15, to assure that the plate flange 76 is brought into forced registration with the shoulder 64, for example, to form a leakproof joint. When the direction of movement of the piston rod 132 and mandrel 222 is reversed or upward viewing FIG. 15, the elastic memory of the block 204 will move the jaw members 112 and 114 back to their starting positions in cooperation with cam surfaces 238 on the mandrel 222 similar to the cam surfaces 138 on the mandrel 122. Thanks to the provision for axial displacement of the jaws 112 and 114 by deforming the block 204 the expander 200 will accommodate variations in metal thickness of the plate assembly 70 and the heat exchanger rim portions 52 and 60. Accordingly, this arrangement will accommodate dimensional tolerances in sheet metal thicknesses or the expander 200 may be used in conjunction with assembling heat exchanger units of varying metal thickness.

The expander units 100 and 200 are substantially similar in construction and operation except for the aforementioned provision of the deformable annular block or body member 204 which permits axial movement of the jaws along the axis 216 after completion of the radial outward displacement of the jaws. In a procedure utilizing the expander apparatus 200 it would normally be necessary and desirable to insert a second expander of similar construction but having the different jaw pattern as discussed above in construction with FIGS. 12 and 13 to displace the flanges in the aras 144 which were not fully clinched or folded during the first stage of the process.

Figure 21:
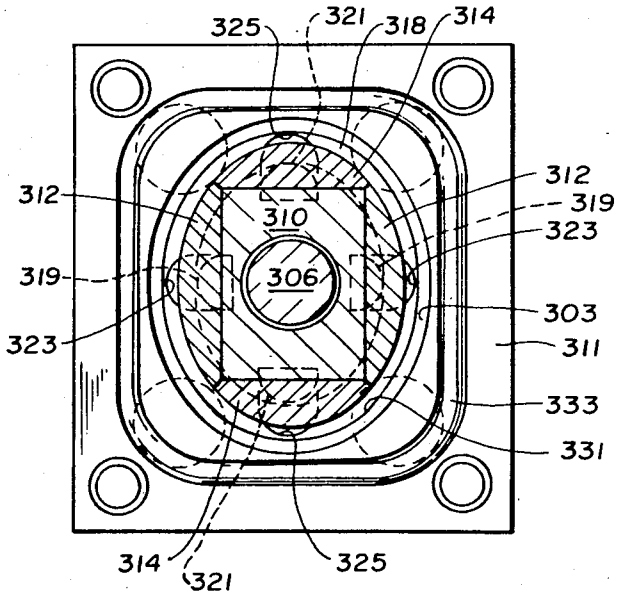
FIG. 21 is an end view of the apparatus shown in FIG. 20.
Figure 20:
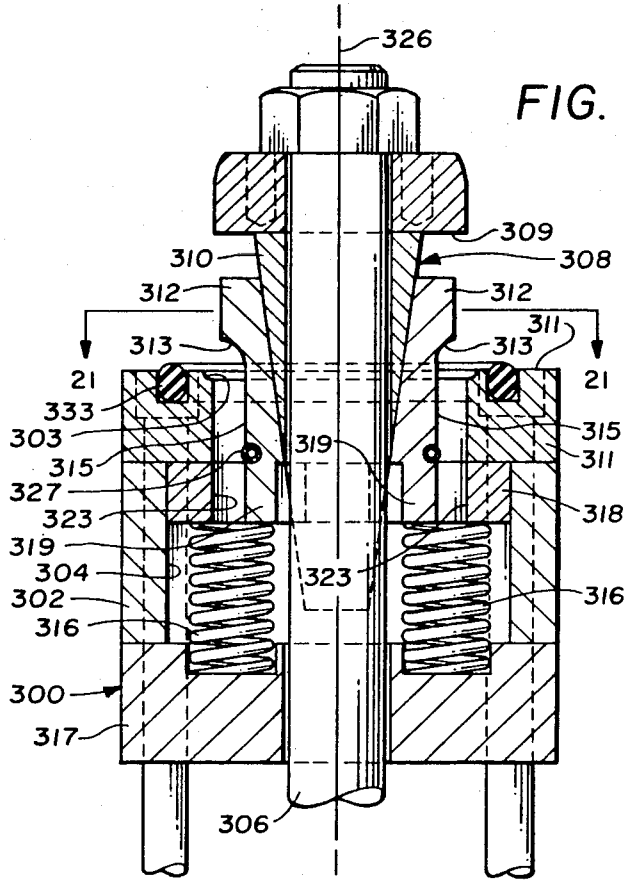
FIG. 20 is a longitudinal section view of a pressing apparatus for forming the joint shown in FIGS. 16 through 19.

A further modification of the present invention is illustrated in FIGS. 16 through 21. Referring to FIGS. 20 and 21, there is illustrated a joint expanding and forming apparatus, generally designated by the numeral 300 having a body member 302 with a longitudinal bore 304. The body member 302 is suitably connected to a hydraulic cylinder and piston assembly, not shown, similar to the cylinder assembly 134 and having a piston rod 306 which is connected to a mandrel 308. The mandrel 308 includes a transverse flange portion 309 and a shank portion 310 having a somewhat truncated pyramidal shape. The mandrel 308 is surrounded by four curling jaw members 312 and 314, opposed ones of which are of the same shape and which are radially expandable outwardly to engage the flange and rim joint previously described. The jaw members 312 and 314 are biased toward engagement with the flange 309 by coil springs 316 disposed in the bore 304 and interposed between a movable support plate 318 for the bases of the respective jaw members and an end plate 317. The jaw members 312 and 314 are each provided with depending key portions 319 and 321 which are radially slidably disposed in respective opposed slots 323 and 325 in the plate 318.

The jaw segments 312 and 314 are adapted to move radially outwardly into engagement with the flange 76 in response to downward axial displacement of the mandrel 308, viewing FIGS. 16 through 20, as previously described. Continued axial displacement of the mandrel 308, with respect to axis 326, FIG. 20, moves the jaw members 312 and 314 axially in the oval bore 304 so that a radial outward and downward curling action of the distal edges of the aforementioned flanges may be carried out to press the flanges tightly into engagement with the cooperating shoulder formed by the rim of the opening in the heat exchanger assembly.

Figure 16:
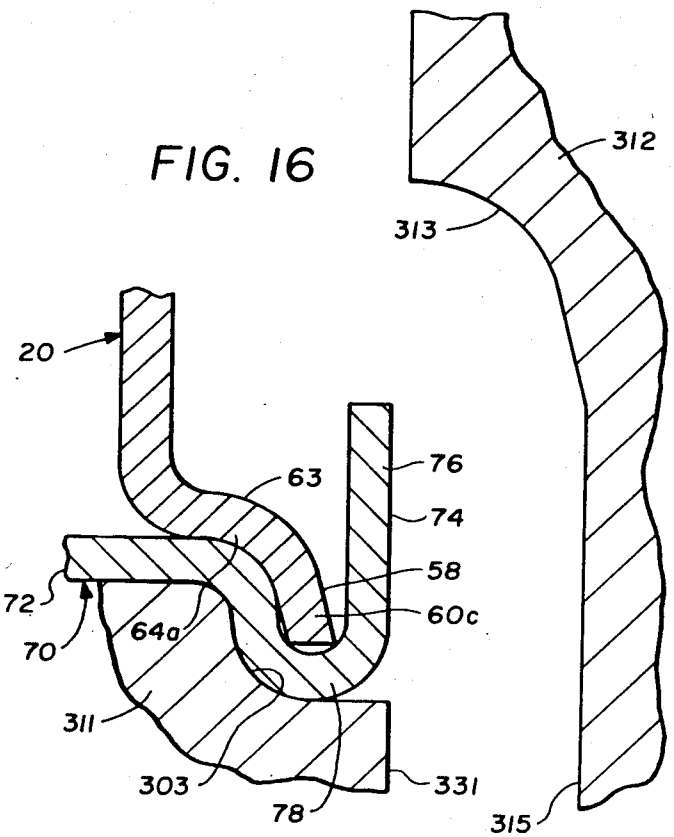
Figure 19:
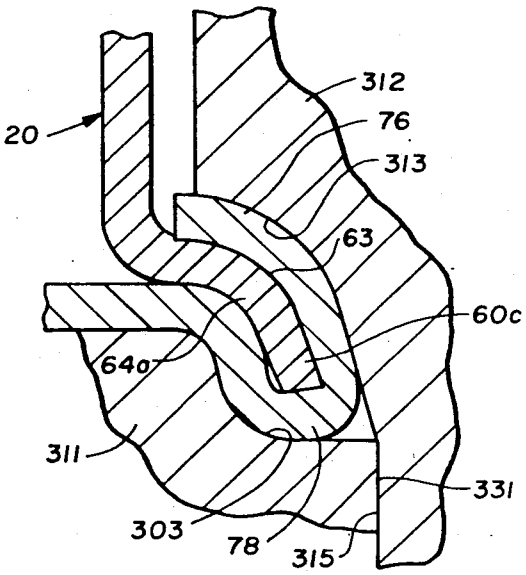
Figure 18:
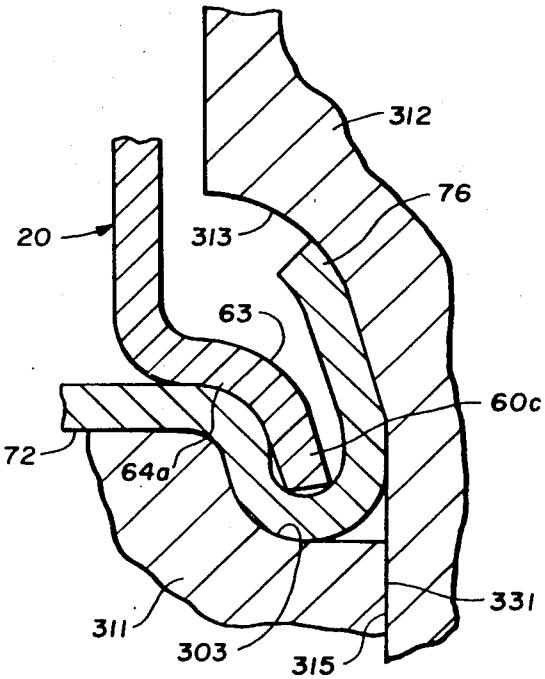

Referring now to FIGS. 16 through 19, in particular, there is shown the formation of a joint in accordance with a method utilizing the expander apparatus 300. Only a partial half section of the joint is shown in the interest of clarity and conciseness. In forming an opening between a partition plate 72 and a heat exchanger unit 20 a modified rim configuration defining the smoke outlet opening 58 is provided with the profiles illustrated in FIGS. 16 through 19. The rim 60c has a relatively generous curved radius 63 formed between the axially projecting rim portion and the transverse shoulder **64*a*. The flange 76, including the channel shaped portion 78, is supported by a die member 311 on the apparatus 308 and having an oval recess 303 as shown. A resilient ring member 333 is disposed in a groove in the die member 311 for engagement with the plate member adjacent to the groove 303. In FIGS. 16 through 19 a typical one of the curling jaw members 312 is shown in detail and is provided with the curved curling surface portion 313 which blends into an axially extending portion 315. The jaws 312 and 314 may be retracted by axial upward extension of the mandrel 308 to move the jaws radially inward towards the axis under the urging of a garter spring 327, FIG. 20, disposed in cooperating grooves formed in each of the jaw members. With the jaws 312 and 314 retracted radially inwardly toward each other the jaws and the head of the mandrel 308 may be inserted through the opening 74 and positioned as indicated in FIG. 16**.

Actuation of the piston rod 306 to draw the mandrel 308 downwardly, viewing FIGS. 16 through 20, will effect radial outward displacement of the jaws 312 and 314 until the surfaces 313 of the jaws 312, for example, engage a sidewall portion 331 forming an oval shaped bore in the die member 311. The jaws 312 and 314 and the mandrel 308 are proportioned such that the upwardly facing transverse surfaces of the jaws will engage the surface 309 on the mandrel 308 when the jaws are also just in light contact with the borewall 331. Continued axial displacement of the mandrel 308 downwardly, viewing FIG. 18, will result in engagement of the distal edge of the flange 76 by the surfaces 313 on the jaws 312 and corresponding surfaces on the jaws 314 to commence a radially outwardly directed expansion or curling action on the flange. As the jaws 312 and 314 are moved to the position shown by way of example for the jaw 312 in FIG. 19, the flange 76 is curled radially outwardly and axially downwardly and forcibly engaged with the shoulder **64*a*. The channel shaped flange portion 78 is also squeezed between the surfaces 313 and the groove 303 by radial outward displacement of the flange 76 to securely trap the rim 60*c*. Partial displacement of metal of the distal end of flange 76 into the shoulder 64*a*, and of the distal end of the rim 60*c* into the flange portion 78** may be incurred to lock or clinch the flange in the expanded position shown.

After clinching the flange 76 by the respective jaw members 312 and 314, simultaneously, the jaw members may be retracted by extending the mandrel 308 upwardly, viewing FIGS. 16 through 20, whereby the springs 316 will force the jaw members and the plate 318 upward until the plate 318 engages the shoulder formed in the bore 304 by the die member 311, as shown in FIG. 20. As the mandrel 308 is moved farther upward the garter spring 327 will force the jaw members 312 and 314 radially inward toward each other and toward the axis 326, FIG. 20. The expander apparatus 300 may then be withdrawn from the opening 74 and a secondary expansion operation performed in accordance with the previous description to clinch the areas on the circumference of the expanded flange 76 which were not engaged directly by the curling jaws 312 and 314. The expander apparatus 300 is, of course, also adapted to accommodate dimensional variations in the thickness of the flanges 76 and the rims **60*c* due to the combined radial and axial movement of the jaws 312 and 314**.

Figure 22:
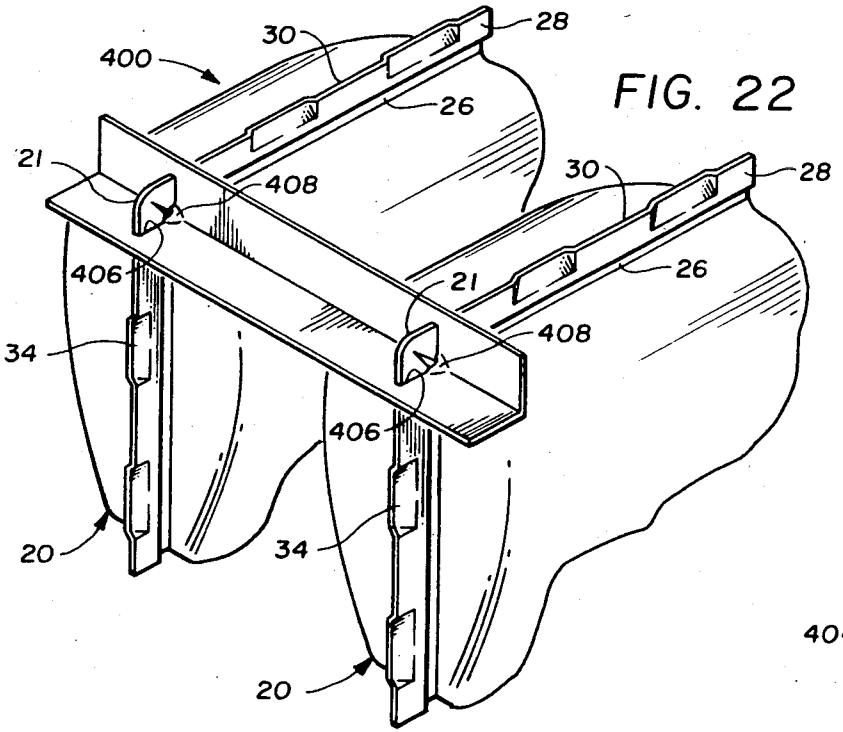
FIG. 22 is a perspective view showing an arrangement for joining the heat exchanger units together at a side opposite the partition and support plate assembly.
Figure 23:
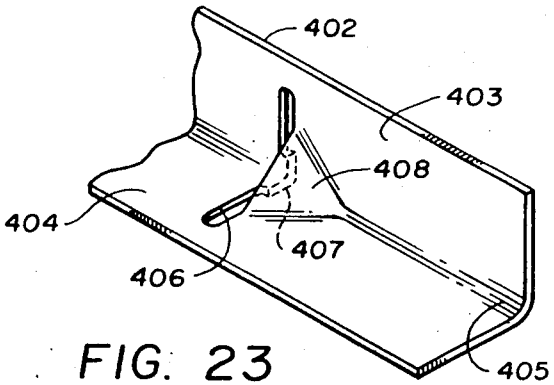
FIG. 23 is a detail view of the support bracket shown in FIG. 22.

Referring now to FIG. 22, there is shown a perspective view of a portion of a complete heat exchanger and plate assembly, generally designated by the numeral 400 wherein the respective heat exchanger units 20 are rigidly interconnected to each other at the corner formed by the edges 30 and 34 opposite the plate assembly 70. As shown in FIG. 22 the respective heat exchanger units 20 are secured together spaced apart by an elongated "L" shaped support member 402 having opposed legs 403 and 404 extending at substantially perpendicular to each other. Referring also to FIG. 23, the member 402 is provided with spaced apart transversely extending notches 406, one shown, which are each provided with a tang 407 and a somewhat triangular shaped gusset 408 disposed opposite the tang and formed by displacing metal along a longitudinal side of the notch 406 into a plane which intersects the planes of the legs 403 and 404. The notch 406 may be punched out with the member 402 in a planar configuration before the formation of the legs 403 and 404 which may be carried out by bending the member along a longitudinal ine 405. Upon bending the member 402 to the configuration shown in FIG. 23 the gusset portions 408 may be formed by displacing material opposite the tangs 407. The spacing of the notches 406 is, of course, equal to the desired spacing of the respective heat exchanger units 20.

Upon assembly of the heat exchanger units 20 to the plate assembly 70 or, conversely, prior thereto, the heat exchanger units may be secured together at a predetermined spacing by insertion of the corners 21 into the respective notches 406, as shown in FIG. 22. The gusset portions 408 may then be bent inwardly towards the line of intersection 405 to clinch the flanges of the respective heat exchanger units securely in the notches.

The improvements realized by the method and apparatus of the present invention will be recognized and appreciated by those skilled in the art, and it will be further recognized that various substitutions and modifications may be made to the specific embodiments described herein without departing from the scope and spirit of the invention as recited in the appended claims.

What we claim is:

1. Apparatus for use in securing a heat exchanger unit to a plate member wherein:

said heat exchanger unit includes an oval shaped opening into an interior chamber through a wall of said heat exchanger unit and said plate member includes an oval shaped opening corresponding to said opening in said heat exchanger unit and defined by an oval shaped perimeter flange projecting from a plane of said plate member and said plate member is assembled with said heat exchanger unit by inserting said flange through said opening in said heat exchanger unit, and said apparatus comprises:

a plurality of flange engaging jaw segments, each jaw segment defining an engaging surface forming an oval portion to engage a portion of the flange, a body member for supporting said plurality of flange engaging jaw segments for insertion through said openings in said plate member and said heat exchanger unit, means for moving said flange engaging jaw segments radially outward with respect to an axis and axially with respect to said axis to bend said flange into engagement with said heat exchanger unit about an oval shaped path and to compensate for variations in metal thickness of at least one of said flange and said wall to form a substantially rigid leakproof joint, and means for retracting said jaw segments for withdarwing said jaw segments through said openings.

2. The apparatus set forth in claim 1 including:

a mandrel including surface means engageable with cooperating surface means on said jaw segments, respectively, means for moving said mandrel axially with respect to said jaw segments and means cooperable with said jaw segments to permit radial outward movement of said jaw segments by said mandrel followed by axial movement of said jaw segments by said mandrel to bend said flange into engagement with said wall.

3. The apparatus set forth in claim 2 wherein:

said means cooperable with said jaw segments comprises yieldable means operably engageable with said jaw segments to permit said axial movement of said jaw segments by said mandrel to bend said flange after said jaw segments are moved radially outward by said mandrel.

4. The apparatus set forth in claim 3 wherein said yieldable means comprises an elastically deformable block.

5. The apparatus set forth in claim 3 wherein said yieldable means comprises coil springs.

6. The apparatus set forth in claim 1 wherein said body member defines a continuous oval shaped engaging surface facing the engaging surfaces on said plurality of jaw segments, said means for moving said jaw segments axially with respect to the central axis drawing the facing surfaces of said jaw segments and body member together to join the heat exchanger unit to said plate member.

* * * * *

UNITED STATES PATENT AND TRADEMARK OFFICE

CERTIFICATE OF CORRECTION

PATENT NO. : 4,663,837

DATED : May 12, 1987

INVENTOR(S) : Russell W. Hoeffken, et al.

It is certified that error appears in the above-identified patent and that said Letters Patent is hereby corrected as shown below:

Col. 1, line 10: "Field of the Invention" should be --Technical Field--
Col. 2, line 25: "so called" should be --so-called--
Col. 5, line 31: "continuous" should be --seamless--
Col. 5, line 40: before "seamless" omit "continuous"
Col. 6, line 3: "enhance" should be --enhances--
Col. 6, line 57: "enclosures" should be --chambers--
Col. 7, line 33: "member" should be --part--
Col. 8, line 42: "plate" should be --perimeter--
Col. 9, line 1: "aras" should be --areas--
Col. 9, line 28: "segments" should be --members--
Col. 9, line 34: "oval" should be --longitudinal--
Col. 9, line 53: "308" should be --300--
Col. 9, line 56: "groove" should be --oval recess--
Col. 10, line 9: "surface" should be --flange--
Col. 10, line 10: "borewall" should be --sidewall"
Col. 10, line 21: before "portion" omit "flange"
Col. 10, line 22: "groove" should be --oval recess--
Col. 10, line 26: "flange" should be --channel shaped--
Col. 10, line 43: before "jaws" omit "curling"
Col. 10, line 62: after "tang" insert --407--
Col. 10, line 68: "ine" should be --line--
Col. 11, line 12: "line of intersection" should be --longitudinal line--

UNITED STATES PATENT AND TRADEMARK OFFICE

CERTIFICATE OF CORRECTION

PATENT NO. : 4,663,837

DATED : May 12, 1987

INVENTOR(S) : Russell W. Hoeffken, et al

It is certified that error appears in the above-identified patent and that said Letters Patent is hereby corrected as shown below:

Col. 12, line 8: "withdarwing" should be -- withdrawing --.

Signed and Sealed this

Twenty-ninth Day of September, 1987

*Attest:*

DONALD J. QUIGG

*Attesting Officer*

*Commissioner of Patents and Trademarks*